US012716338B2

(12) United States Patent
Xu et al.

(10) Patent No.: US 12,716,338 B2
(45) Date of Patent: Aug. 25, 2026

(54) GAS INJECTION METHOD AND SYSTEM FOR DEEP STRONG BOTTOM WATER SANDSTONE RESERVOIR

(71) Applicants: CHINA PETROLEUM & CHEMICAL CORPORATION, Beijing (CN); SINOPEC EXPLORATION & PRODUCTION RESEARCH INSTITUTE, Beijing (CN)

(72) Inventors: Ting Xu, Beijing (CN); Yingfu He, Beijing (CN); Haiying Liao, Beijing (CN); Maolei Cui, Beijing (CN); Jun Nie, Beijing (CN); Yang Yang, Beijing (CN)

(73) Assignees: CHINA PETROLEUM & CHEMICAL CORPORATION, Beijing (CN); SINOPEC EXPLORATION & PRODUCTION RESEARCH INSTITUTE, Beijing (CN)

( * ) Notice: Subject to any disclaimer, the term of this patent is extended or adjusted under 35 U.S.C. 154(b) by 404 days.

(21) Appl. No.: 18/557,067

(22) PCT Filed: Nov. 23, 2022

(86) PCT No.: PCT/CN2022/133843
§ 371 (c)(1),
(2) Date: Oct. 25, 2023

(87) PCT Pub. No.: WO2023/098543
PCT Pub. Date: Jun. 8, 2023

(65) Prior Publication Data

US 2024/0218770 A1 Jul. 4, 2024

(30) Foreign Application Priority Data

Nov. 30, 2021 (CN) ..... 202111448648.1

(51) Int. Cl.
*G06F 11/30* (2006.01)
*E21B 43/16* (2006.01)

(52) U.S. Cl.
CPC ..... *E21B 43/168* (2013.01); *E21B 2200/20* (2020.05)

(58) Field of Classification Search
CPC ..... E21B 43/168
See application file for complete search history.

(56) References Cited

U.S. PATENT DOCUMENTS 5,725,054 A 3/1998 Shayegi et al.
2016/0009981 A1* 1/2016 Teklu ..... C09K 8/594 166/305.1
2020/0202060 A1 6/2020 Thakur et al.

FOREIGN PATENT DOCUMENTS

CN 109138943 A 1/2019
CN 110110354 * 8/2019
(Continued)

OTHER PUBLICATIONS

PCT/CN2022/133843 Translation Written Opinion of the International Searching Authority, Feb. 20, 2023 (Year: 2023).*

*Primary Examiner* — Phuong Huynh
(74) *Attorney, Agent, or Firm* — NKL Law; Allen Xue

(57) ABSTRACT

In a gas injection method for deep-layer strong bottom water reservoir, a plurality of gas injection mediums is provided for the present reservoir at issue, and a miscible feature of each gas injection medium in crude oil of the present reservoir is analyzed, so as to select a number of target gas injection mediums, which is combined with a well group simulation model corresponding to the present reservoir to obtain an optimal gas injection ratio between the target gas injection mediums. Based on the optimal gas injection ratio and the well group simulation model, gas injection simulation is performed for the present reservoir through a plurality
(Continued)

of gas injection modes respectively to obtain an increment in recovery efficiency corresponding to each gas injection mode, thereby determining an optimal gas injection mode. Gas injection then is performed in the present reservoir through the optimal gas injection mode.

9 Claims, 10 Drawing Sheets

(56) References Cited

FOREIGN PATENT DOCUMENTS

| | | | |
|---|---|---|---|
| CN | 110110354 | A | 8/2019 |
| CN | 110598340 | A | 12/2019 |
| CN | 111456693 | A | 7/2020 |
| CN | 114893158 | A | 8/2022 |

* cited by examiner

GAS INJECTION METHOD AND SYSTEM FOR DEEP STRONG BOTTOM WATER SANDSTONE RESERVOIR

TECHNICAL FIELD

The present invention relates to the field of bottom water reservoir development, and specifically to gas injection method and system for deep-layer strong bottom water sandstone reservoir.

TECHNICAL BACKGROUND

The deep-layer bottom water sandstone reservoir located in the Triassic Formation of the Northwest Oilfield in China is characterized by gentle tectonics (formation dip angle <5), large burial depth (4,600 m), small reservoir thickness (<15 m), large water-oil volume ratio (>100), high temperature and high salt content (120° C., $20\times10^4$ mg/L), and highly non-homogeneous nature, etc. Since the exploitation of the deep-layer bottom water sandstone reservoir was started in 2002, natural energy of straight well is mainly relied, and a number of horizontal wells have been drilled in the construction and production stages. Therefore, the reservoir has a high production capacity in an early stage of development, which lays a sound foundation for stable oil production. In recent years, however, the development of the deep-layer bottom water sandstone reservoir has been affected by coning/cresting of strong bottom water. The proportion of high water content wells as well as low production and efficiency wells has gradually increased, and horizontal wells have been seriously flooded by water. As a result, the deep-layer bottom water sandstone reservoir has entered a medium-high water content stage (with a composite water cut of 87.7%), which results in a low single well production (<5 t/d), at which time the recovery efficiency of the deep-layer bottom water sandstone reservoir is only 26.0%.

At present, the development of deep-layer bottom water sandstone reservoir in the middle and late stages faces the following problems when the recovery efficiency is intended to be significantly increased.

First of all, water plugging methods, such as barriers, are commonly used at home and abroad in order to control the coning/cresting of bottom water and force the bottom water to move laterally, thereby utilizing residual oil shielded by horizontal sections and residual oil-rich areas between wells to improve recovery efficiency of strong bottom water reservoirs. In early and middle stages of reservoir development, a variety of water plugging techniques for horizontal wells has been adopted with good recovery effect. However, with an increase in the rounds of water plugging and oil enhancement, water flooding condition of horizontal wells becomes increasingly complex, and distribution of residual oil in the reservoir to be recovered becomes increasingly scattered, which lead to increasingly worse recovery effect of the water plugging techniques year by year. Therefore, it is necessary to explore in depth how to improve the displacement of the bottom water and how to enhance the utilization of the residual oil between wells.

Secondly, in order to utilize the residual oil between wells and overcome a preferential seepage field generated by vertical uplift of bottom water, a well group with a relatively developed intercalated bed is preferably carried out a pilot test of water flooding and bypass flow field, so as to lay a foundation for improving the recovery efficiency of strong bottom water reservoir. Since the injected water is first transported to lower water body during the test, a lateral expansion of swept volume cannot be realized. Moreover, increasing the recovery efficiency of strong bottom water reservoir based on the current pilot test will result in continuous increases in water content of the corresponding wells, and it will be more difficult to utilize the residual oil between wells, which will lead to unsatisfactory effect on increasing the final production rate.

Finally, the deep-layer reservoir is characterized by high temperature and high salt content, so the chemical displacement thereof has poor adaptability. Nitrogen foam displacement technology can achieve a satisfactory effect. In the prior arts, nitrogen foam displacement in three well groups can increase 5,811 tons of oil production. In addition, most of the existing natural gas injection experiments abroad for the development of strong bottom water reservoirs are carried out for reservoirs with a structural dip angle greater than 15. The test results show that the development of strong bottom water reservoirs through natural gas injection can increase the recovery efficiency by approximately 10%.

However, it is found that there is a lack of effective method for stabilizing oil and controlling water during high water-content developing stage of deep-layer bottom water sandstone reservoirs at present, so there is an urgent need to explore new technologies and methods for substantially improving the recovery efficiency.

SUMMARY OF THE INVENTION

One of the technical problems to be solved by the present invention is to provide a gas injection method for deep-layer strong bottom water reservoir, which comprises the following steps. A plurality of gas injection mediums is provided for the present reservoir at issue, and a miscible feature of each gas injection medium in crude oil of the present reservoir is analyzed, so as to select a number of target gas injection mediums that are conducive to utilizing residual oil in the present reservoir from the plurality of gas injection mediums. The number of target gas injection mediums is combined with a well group simulation model corresponding to the present reservoir to analyze an exploitation rule of the residual oil, and thus an optimal gas injection ratio between the target gas injection mediums is obtained. Based on the optimal gas injection ratio and the well group simulation model, gas injection simulation is performed for the present reservoir through a plurality of gas injection modes respectively, so as to obtain an increment in recovery efficiency corresponding to each gas injection mode, thereby determining an optimal gas injection mode. Then, gas injection is performed in the present reservoir through the optimal gas injection mode according to the optimal gas injection ratio.

Preferably, the step of analyzing a miscible feature of each gas injection medium in crude oil of the present reservoir comprises: determining whether each gas injection medium has a minimum miscible pressure in the crude oil of the present reservoir, so as to select a plurality of first gas injection mediums that has a miscible ability; selecting a plurality of second gas injection mediums compatible with an average formation pressure of the present reservoir from the plurality of first gas injection mediums, according to a minimum miscible pressure of each first gas injection medium in combination with the average formation pressure of the present reservoir; and determining the target gas injection mediums according to dissolution rule and density of each second gas injection medium in the present reservoir.

Preferably, the step of determining whether each gas injection medium has a minimum miscible pressure in the crude oil of the present reservoir so as to select a plurality of first gas injection mediums that has a miscible ability comprises: obtaining, based on a slim-tube miscible experiment in combination with numerical simulation and prediction, a correlation between miscible pressure and recovery efficiency of each gas injection medium in the crude oil of the present reservoir, and selecting the first gas injection mediums by determining whether each gas injection medium has a minimum miscible pressure in the crude oil of the present reservoir.

Preferably, a curve showing the correlation between the miscible pressure and the recovery efficiency of each gas injection medium is drawn, so as to determine whether a current gas injection medium has the miscible ability in the present reservoir based on an inflection point of slope of the curve, wherein if the inflection point exists, a pressure at the inflection point is taken as the minimum miscible pressure, and if not, it is determined that the current gas injection medium does not have the miscible ability in the present reservoir.

Preferably, the step of selecting a plurality of second gas injection mediums compatible with an average formation pressure of the present reservoir from the plurality of first gas injection mediums according to a minimum miscible pressure of each first gas injection medium in combination with the average formation pressure of the present reservoir comprises: comparing the minimum miscible pressure of each first gas injection medium with the average formation pressure, and obtaining the first gas injection mediums with the minimum miscible pressure less than the average formation pressure as the plurality of second gas injection mediums.

Preferably, the step of determining the target gas injection mediums according to dissolution rule and density of each second gas injection medium in the present reservoir comprises: obtaining, through a combination of indoor experiments and numerical simulation, a distribution feature and a miscible feature of each second gas injection medium in the present reservoir, so as to obtain a first target gas injection medium that is soluble in water and oil; and determining a second gas injection medium with a smallest density as a second target gas injection medium.

Preferably, the step of determining the first target gas injection medium comprises: performing exploitation simulation for the present reservoir through seepage flow experiment and phase state experiment, thus obtaining changes in phase state of fluid in the present reservoir; configuring reservoir exploitation parameters, and calculating relevant parameters characterizing the changes in phase state of fluid in the present reservoir through numerical simulation, so as to obtain a distribution rule of the residual oil; obtaining a dissolution feature of each second gas injection medium in formation water of the present reservoir through dissolution experiment, so as to obtain dissolution, migration and distribution rules of each second gas injection medium in the formation water of the present reservoir through numerical simulation; obtaining a diffusion feature of each second gas injection medium in single-phase oil, single-phase water and single-phase gas of the present reservoir through diffusion experiment, so as to obtain the diffusion rule of each second gas injection medium in the present reservoir; configuring injection-production parameters to analyze, through numerical simulation, different displacement effect obtained by injecting each second gas injection medium into the present reservoir, in order to obtain an influence of each second gas injection medium on the displacement effect with the dissolution and diffusion rules being taken into consideration; and combining the distribution feature and the miscible feature of each second gas injection medium in the present reservoir together, so as to obtain a concentration distribution of each second gas injection medium in the present reservoir during early, middle and subsequent depletion exploitation stages of gas injection, so that the gas injection medium having a dissolution ratio varies stably with injection time is taken as the first target gas injection medium that is soluble in oil and water.

Preferably, the step of determining an optimal gas injection ratio comprises: configuring different mixed ratios for the first target gas injection medium and the second target gas injection medium, and performing gas injection simulation in the well group simulation model through a preset first gas injection mode according to each mixed ratio, so as to obtain an increment in recovery efficiency corresponding to each mixed ratio, thereby determining the optimal gas injection ratio.

Preferably, the gas injection modes comprise continuous gas injection, gas injection with different gas injection slug ratios, cyclical gas injection and water-gas alternate injection.

Preferably, the step of determining an optimal gas injection mode comprises: performing gas injection simulation in the well group simulation model according to the optimal gas injection ratio, so as to obtain an increment in recovery efficiency corresponding to each gas injection mode, thereby determining the gas injection mode with a largest increment in recovery efficiency as the optimal gas injection mode.

Preferably, the gas injection method for deep-layer strong bottom water sandstone reservoir according to the present invention further comprises: configuring different injection-production parameters for the present reservoir; and performing, based on the target gas injection mediums, the optimal gas injection ratio and the optimal gas injection mode, gas injection simulation in the present reservoir through the well group simulation model according to each injection-production parameter, so as to obtain an increment in recovery efficiency corresponding to each injection-production parameter, based on which an optimal injection-production parameter of the present reservoir is determined.

Preferably, the gas injection mediums comprise $CO_2$, $CH_4$ and $N_2$.

In another aspect of the present invention, a gas injection system for deep-layer strong bottom water sandstone reservoir is provided, characterized in that the system comprises: a target gas injection medium acquisition module, configured so that a plurality of gas injection mediums is provided for a present reservoir at issue, and a miscible feature of each gas injection medium in crude oil of the present reservoir is analyzed, so as to select a number of target gas injection mediums that are conducive to utilizing residual oil in the present reservoir from the plurality of gas injection mediums; a gas injection ratio acquisition module, configured so that an exploitation rule of the residual oil is analyzed based on the number of target gas injection mediums in combination with a well group simulation model corresponding to the present reservoir, in order to obtain an optimal gas injection ratio between the target gas injection mediums; a gas injection mode acquisition module, configured so that gas injection simulation is performed in the present reservoir through each of a plurality of gas injection modes based on the optimal gas injection ratio and the well group simulation model, and an increment in recovery efficiency corresponding to each gas injection mode is obtained, based on which an optimal gas injection mode is determined; and a gas injection operation module, configured so that gas injection is performed in the present reservoir based on the optimal gas injection mode and the optimal gas injection ratio.

Compared with the prior arts, one or more of the embodiments in the above technical solutions have the following advantages or advantageous effects.

The present invention proposes a gas injection method for deep-layer strong bottom water reservoir. In this method, a number of target gas injection mediums that are conducive to utilizing the residual oil in the reservoir are obtained by evaluating the miscible ability of a plurality of gas injection mediums and the crude oil in the reservoir. Then, according to a well group simulation model constructed based on the deep-layer strong bottom water reservoir at issue, gas injection is simulated for a number of target gas injection mediums with different mixed ratios and one single target gas injection medium respectively, in order to analyze an exploitation rule of utilizing the residual oil, and determine that miscible gas displacement is more conducive to utilizing the residual oil at the top of the reservoir. On this basis, an increment in recovery efficiency corresponding to each mixed ratio is calculated to obtain an optimal gas injection ratio. Next, gas injection is simulated in the well group simulation model through different gas injection modes and a number of target gas injection mediums with the optimal gas injection ratio. On this basis, an increment in the recovery efficiency corresponding to each gas injection mode is calculated to obtain an optimal gas injection mode. Finally, gas injection is performed in the reservoir through the optimal gas injection mode and the number of target gas injection mediums according to the optimal gas injection ratio. The present invention realizes effective oil stabilization and water control in the high water-content development stage of deep-layer strong bottom water reservoirs, and significantly improves the recovery efficiency in the middle and late stages of reservoir exploitation.

Other features and advantages of the present invention will be set forth in the description which follows, and, in part, will be apparent from the description, or may be learned from the implementation of the present invention. The objective and other advantages of the present invention may be realized and attained from the structure particularly pointed out in the description, claims and drawings.

BRIEF DESCRIPTION OF THE DRAWINGS

The accompanying drawings are used to provide a further understanding on the present invention, and constitute a part of the description. Together with the embodiments of the present invention, the drawings are intended to explain the present invention, but not constitute any limitation to the present invention. In the drawings.

DETAILED DESCRIPTION OF EMBODIMENTS

Figure 1:
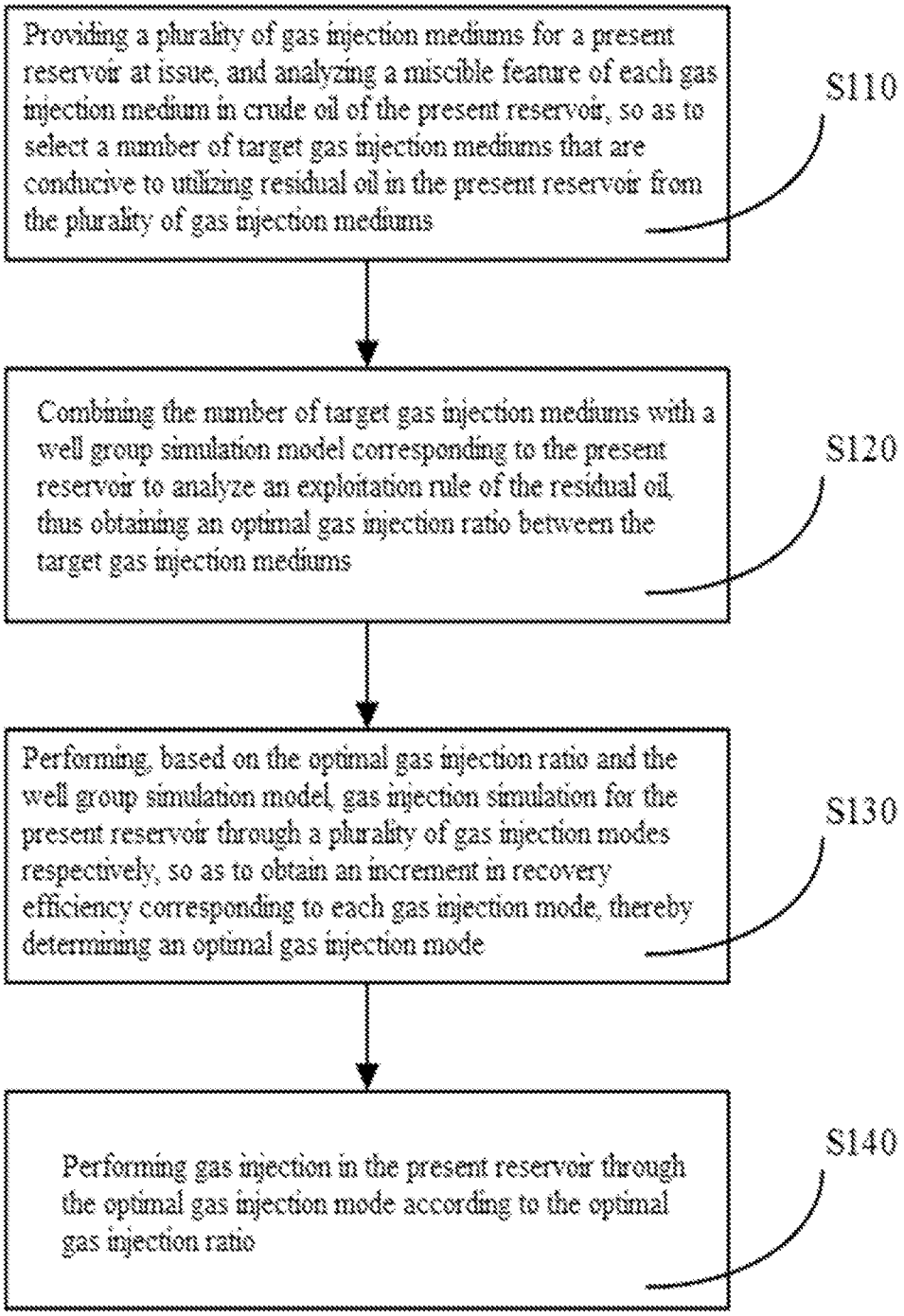
FIG. 1 shows steps of a gas injection method for deep-layer strong bottom water sandstone reservoir according to embodiments of the present application.

The implementation mode of the present invention will be explained in detail with reference to the embodiments and the accompanying drawings, whereby it can be fully understood how to solve the technical problem by the technical means according to the present invention, implement the technical solution, and achieve the technical effects thereof. It should be noted that all the embodiments and the technical features defined therein may be combined together if there is no conflict, and the technical solutions obtained in this manner shall all fall within the scope of protection of the present invention.

In addition, the steps illustrated in the flow chart in the drawings can be performed in a computer system containing a set of computer-executable instructions. Moreover, although a logical sequence is shown in the flow chart, in some cases these steps as shown or described may be performed in an order different than that shown herein.

The deep-layer bottom water sandstone reservoir located in the Triassic Formation of the Northwest Oilfield in China is characterized by gentle tectonics (formation dip angle <5), large burial depth (4,600 m), small reservoir thickness (<15 m), large water-oil volume ratio (>100), high temperature and high salt content (120° C., $20\times10^4$ mg/L), and highly non-homogeneous nature, etc. Since the exploitation of the deep-layer bottom water sandstone reservoir was started in 2002, natural energy of straight well is mainly relied, and a number of horizontal wells have been drilled in the construction and production stages. Therefore, the reservoir has a high production capacity in an early stage of development, which lays a sound foundation for stable oil production. In recent years, however, the development of the deep-layer bottom water sandstone reservoir has been affected by coning/cresting of strong bottom water. The proportion of high water content wells as well as low production and efficiency wells has gradually increased, and horizontal wells have been seriously flooded by water. As a result, the deep-layer bottom water sandstone reservoir has entered a medium-high water content stage (with a composite water cut of 87.7%), which results in a low single well production (<5 t/d), at which time the recovery efficiency of the deep-layer bottom water sandstone reservoir is only 26.0%.

At present, the development of deep-layer bottom water sandstone reservoir in the middle and late stages faces the following problems when the recovery efficiency is intended to be significantly increased.

First of all, water plugging methods, such as barriers, are commonly used at home and abroad in order to control the coning/cresting of bottom water and force the bottom water to move laterally, thereby utilizing residual oil shielded by horizontal sections and residual oil-rich areas between wells to improve recovery efficiency of strong bottom water reservoirs. In early and middle stages of reservoir development, a variety of water plugging techniques for horizontal wells has been adopted with good recovery effect. However, with an increase in the rounds of water plugging and oil enhancement, water flooding condition of horizontal wells becomes increasingly complex, and distribution of residual oil in the reservoir to be recovered becomes increasingly scattered, which lead to increasingly worse recovery effect of the water plugging techniques year by year. Therefore, it is necessary to explore in depth how to improve the displacement of the bottom water and how to enhance the utilization of the residual oil between wells.

Secondly, in order to utilize the residual oil between wells and overcome a preferential seepage field generated by vertical uplift of bottom water, a well group with a relatively developed intercalated bed is preferably carried out a pilot test of water flooding and bypass flow field, so as to lay a foundation for improving the recovery efficiency of strong bottom water reservoir. Since the injected water is first transported to lower water body during the test, a lateral expansion of swept volume cannot be realized. Moreover, increasing the recovery efficiency of strong bottom water reservoir based on the current pilot test will result in continuous increases in water content of the corresponding wells, and it will be more difficult to utilize the residual oil between wells, which will lead to unsatisfactory effect on increasing the final production rate.

Finally, the deep-layer reservoir is characterized by high temperature and high salt content, so the chemical displacement thereof has poor adaptability. Nitrogen foam displacement technology can achieve a satisfactory effect. In the prior arts, nitrogen foam displacement in three well groups can increase 5,811 tons of oil production. In addition, most of the existing natural gas injection experiments abroad for the development of strong bottom water reservoirs are carried out for reservoirs with a structural dip angle greater than 15. The test results show that the development of strong bottom water reservoirs through natural gas injection can increase the recovery efficiency by approximately 10%.

However, it is found that there is a lack of effective method for stabilizing oil and controlling water during high water-content developing stage of deep-layer bottom water sandstone reservoirs at present, so there is an urgent need to explore new technologies and methods for substantially improving the recovery efficiency.

First Embodiment

FIG. 1 shows steps of a gas injection method for deep-layer strong bottom water sandstone reservoir according to embodiments of the present invention. The specific steps of this method are described below with reference to FIG. 1.

As shown in FIG. 1, in step S110, a plurality of gas injection mediums is provided for the deep-layer strong bottom water reservoir at issue, and a miscible feature of each gas injection medium in crude oil of the present reservoir is analyzed, in order to select a number of target gas injection mediums that are conducive to utilizing residual oil in the present reservoir from the plurality of gas injection mediums.

In the embodiments of the present invention, a plurality of gas injection mediums commonly used during gas injection operation of deep-layer strong bottom water reservoir is provided for the Triassic deep-layer strong bottom water reservoir at issue. Each gas injection medium can be injected separately into the Triassic deep-layer strong bottom water reservoir at issue to improve physical parameters of crude oil in the reservoir, i.e., expand the volume, reduce the viscosity, and increase the fluidity of the crude oil, thus further effectively improving the recovery efficiency. After a variety of gas injection mediums for the reservoir at issue is determined, the miscible feature (e.g., viscosity reduction effect and capacity to dissolve crude oil) of each gas injection medium in the reservoir is analyzed. Then, the viscosity reduction effect and the capacity to dissolve crude oil are compared between each gas injection medium. On this basis, gas injection mediums that are applicable to the reservoir are further selected from the plurality of gas injection mediums, in order to obtain a number of gas injection mediums that are conducive to utilizing the residual oil in the reservoir.

Further, when analyzing the miscible feature of each gas injection medium in the crude oil of the present reservoir, a minimum miscible pressure of each gas injection medium in the crude oil of the reservoir is first determined. Whether each gas injection medium in the crude oil of the reservoir has miscible ability is determined according to whether it has a minimum miscible pressure in the crude oil in the reservoir. In the embodiments of the present invention, the gas injection mediums with a minimum miscible pressure in the crude oil of the reservoir are determined. The gas injection mediums with a minimum miscible pressure are determined as gas injection mediums with the miscible ability in the crude oil of the reservoir. Then, the gas injection mediums with miscible ability in the crude oil of the reservoir are each determined as a first gas injection medium, and other gas injection mediums without miscible ability among the plurality of gas injection mediums are removed, in order to complete a selection of the first gas injection mediums according to the embodiments of the present application, thereby completing a preliminary selection of the target gas injection mediums according to the embodiments of the present application.

Further, when selecting the plurality of first gas injection mediums with miscible ability, a slim-tube miscible experiment is adopted in combination with numerical simulation and prediction, so as to obtain a correlation between the miscible pressure of each gas injection medium in the crude oil of the reservoir and the corresponding recovery efficiency, based on which it can be determined whether each gas injection medium has a minimum miscible pressure in the crude oil of the reservoir. Each gas injection medium with a minimum miscible pressure selected from the plurality of gas injection mediums is determined as a first gas injection medium with miscible ability in the crude oil of the reservoir.

Specifically, a curve showing the correlation between the miscible pressure and the recovery efficiency is drawn for each gas injection medium, wherein an inflection point of the slope of the curve is identified to determine whether the current gas injection medium has the miscible ability in the present reservoir. If the inflection point of the slope exists, the pressure at the current inflection point of the slope is taken as the minimum miscible pressure; if not, it is determined that the current gas injection medium does not have the miscible ability in the present reservoir.

Figure 2:
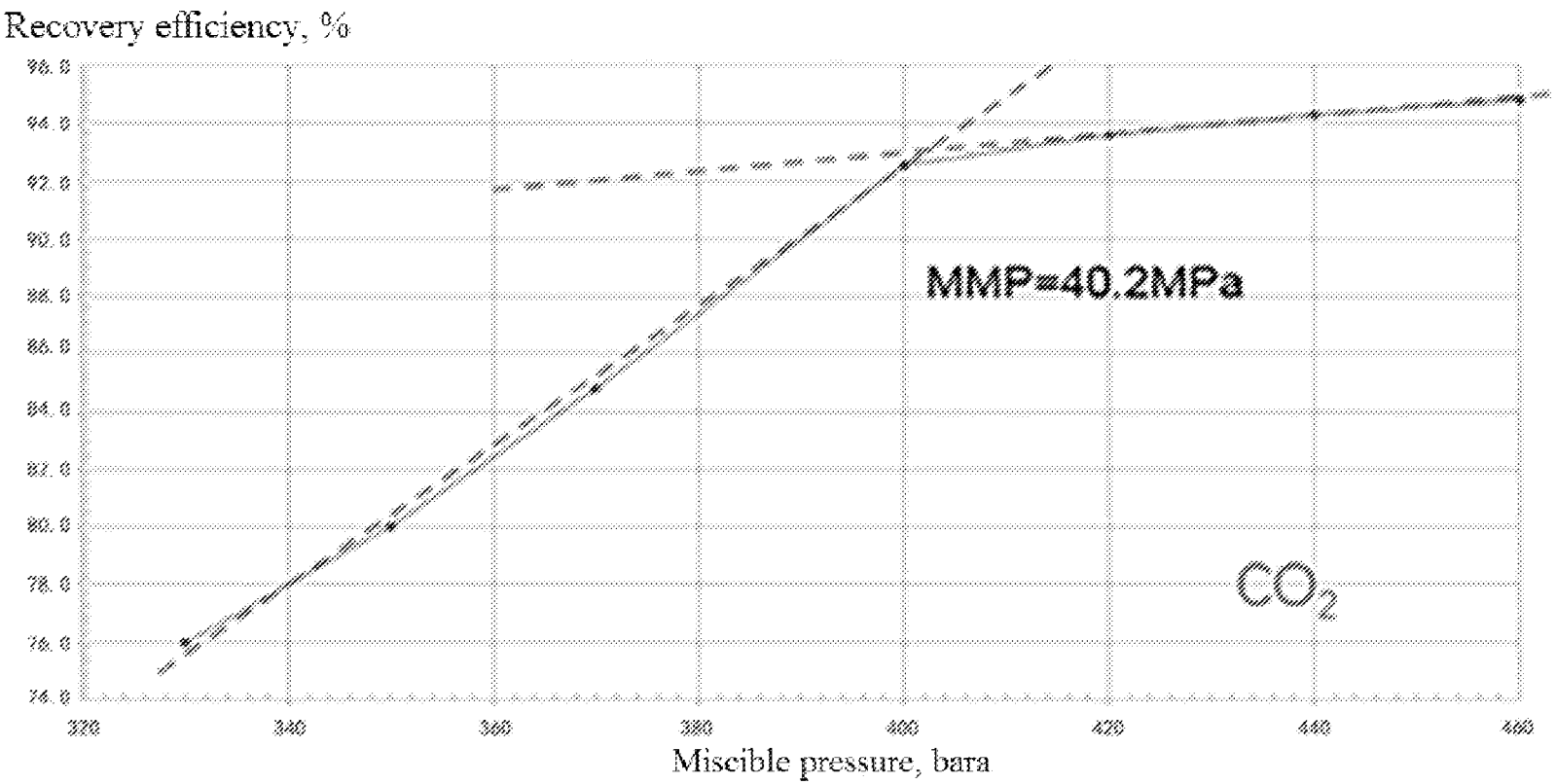
FIG. 2 shows a relationship between miscible pressure and recovery efficiency when gas injection medium is $CO_2$ in the gas injection method for deep-layer strong bottom water sandstone reservoir according to embodiments of the present application.
Figure 3:
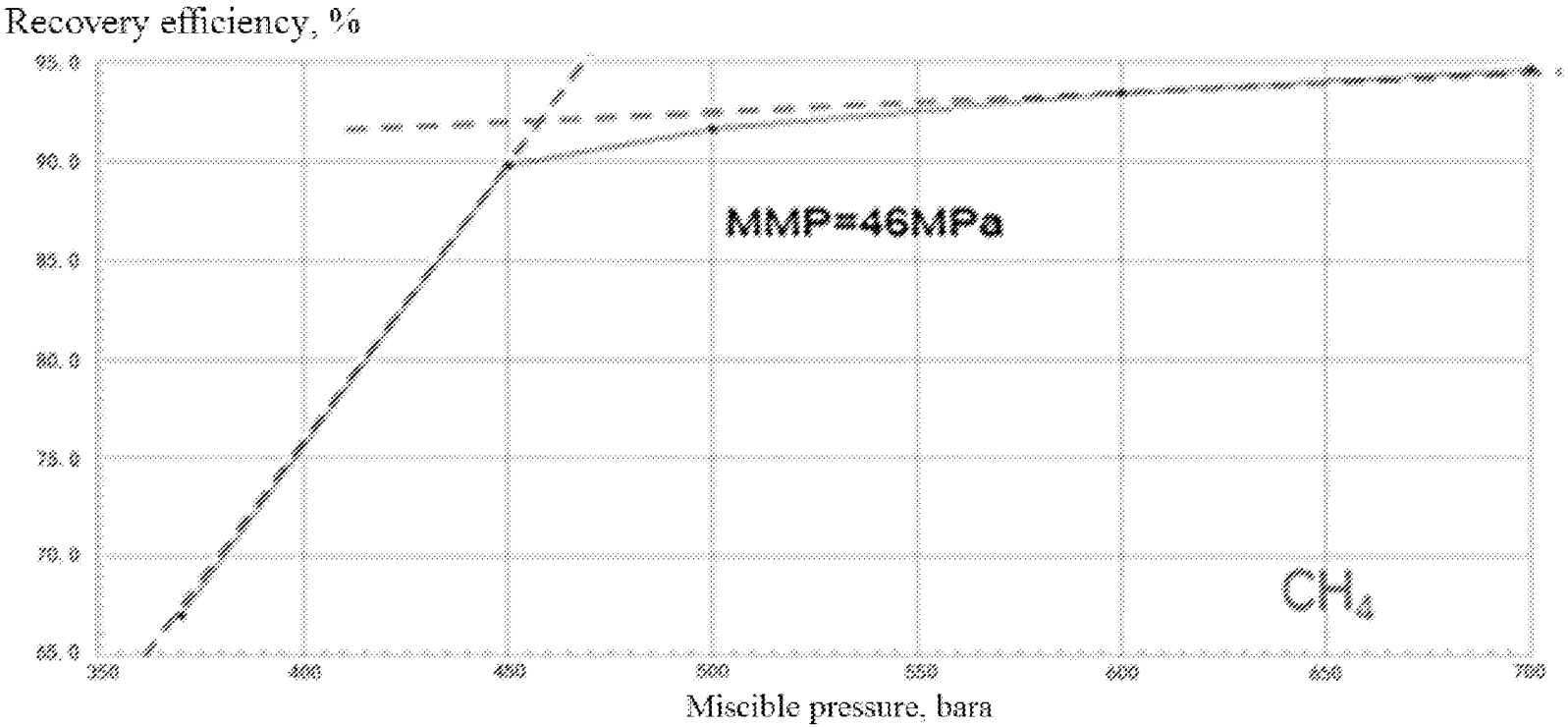
FIG. 3 shows a relationship between miscible pressure and recovery efficiency when gas injection medium is $CH_4$ in the gas injection method for deep-layer strong bottom water sandstone reservoir according to embodiments of the present application.
Figure 4:
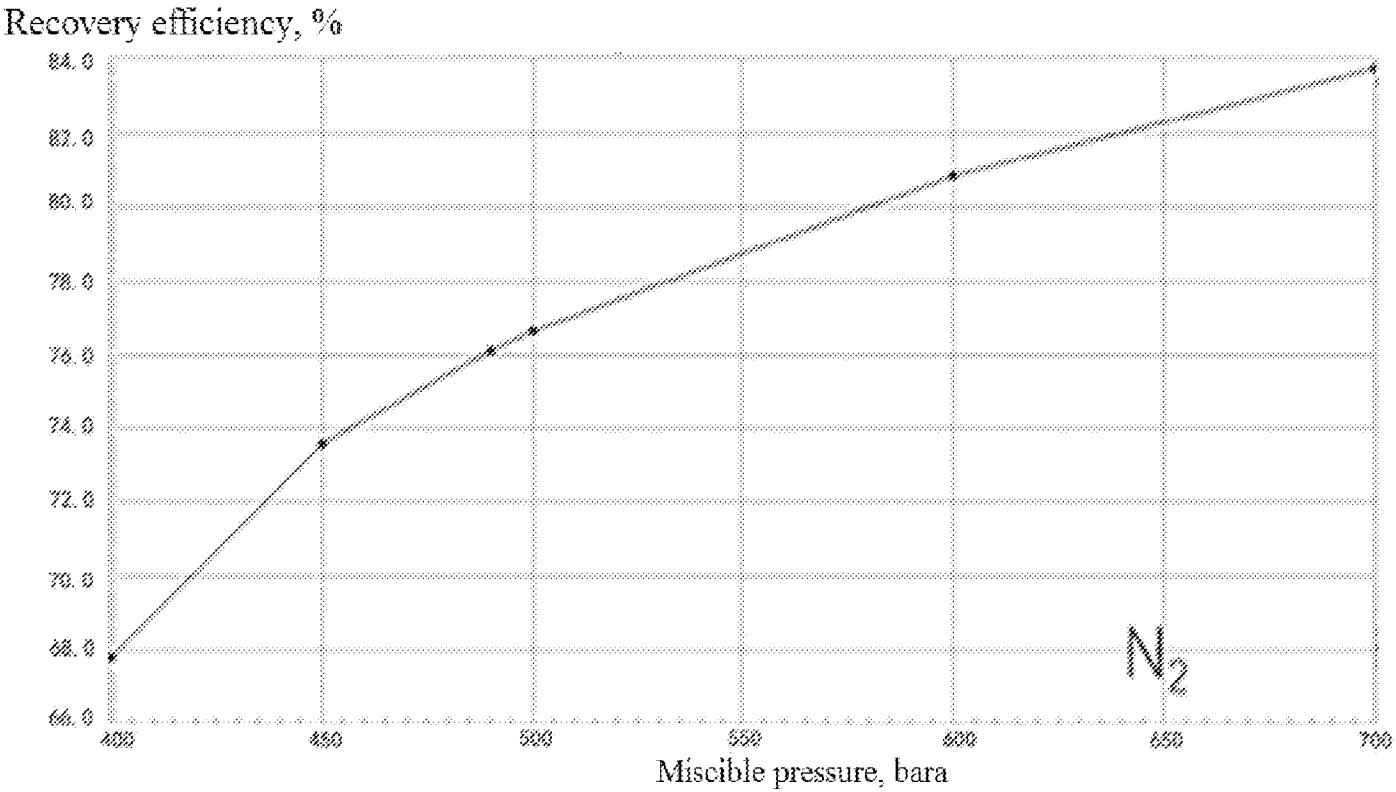
FIG. 4 shows a relationship between miscible pressure and recovery efficiency when gas injection medium is $N_2$ in the gas injection method for deep-layer strong bottom water sandstone reservoir according to embodiments of the present application.

Specifically, crude oil is collected from the Triassic deep-layer strong bottom water reservoir at issue to carry out the slim-tube miscible experiment, wherein a slim tube filled with fine sand is used to simulate the state of porous medium of rock in the present reservoir. Then a plurality of different miscible pressures are configured for each of the gas injection mediums for the miscible displacement experiment, and each gas injection medium is injected into the slim tube filled with fine sand according to each miscible pressure for the miscible displacement experiment. Then, based on the state of porous medium of rock in the present reservoir obtained by experimental simulation, and in combination with different miscible pressures associated with each gas injection medium for the miscible displacement experiment, the recovery efficiency corresponding to said different miscible pressures of each gas injection medium are calculated through the numerical simulation and prediction method, respectively, in order to obtain a relationship between each of different miscible pressures and the corresponding recovery efficiency for each gas injection medium in the crude oil of the present reservoir, thus obtaining the relationship between the miscible pressure and the recovery efficiency for each gas injection medium in the crude oil of the present reservoir. In this manner, a curve characterizing the relationship between the miscible pressure and the recovery efficiency for each gas injection medium in the crude oil of the present reservoir is obtained (as shown in FIGS. 2, 3 and 4). When analyzing the curve characterizing the relationship between the miscible pressure and the recovery efficiency for each gas injection medium, a pressure value corresponding to a sudden change in slope (i.e., the inflection point) of each curve is taken as the minimum miscible pressure. As a result, each of the gas injection mediums with a relationship curve having a sudden change in slope (i.e., the inflection point) is taken as a first gas injection medium with miscible ability in the crude oil of the present reservoir.

It should be noted that the miscible pressure of each gas injection medium for the miscible displacement experiment is not limited in the embodiments of the present invention, and can be selected by one skilled in the art according to actual needs.

FIG. 2 shows a relationship between miscible pressure and recovery efficiency when gas injection medium is $CO_2$ in the gas injection method for deep-layer strong bottom water sandstone reservoir in the embodiments of the present application. FIG. 3 shows a relationship between miscible pressure and recovery efficiency when gas injection medium is $CH_4$ in the gas injection method for deep-layer strong bottom water sandstone reservoir in the embodiments of the present application. FIG. 4 shows a relationship between miscible pressure and recovery efficiency when gas injection medium is $N_2$ in the gas injection method for deep-layer strong bottom water sandstone reservoir in the embodiments of the present application. In the following, examples of determining whether each gas injection medium has the miscible ability in the crude oil of the present reservoir based on the minimum miscible pressure of each gas injection medium obtained from FIGS. 2, 3 and 4 are illustrated.

In one embodiment of the present application, the gas injection mediums for the deep-layer strong bottom water reservoir at issue include $CO_2$, $CH_4$ and $N_2$. According to the curve characterizing a relationship between miscible pressure and recovery efficiency as shown in FIG. 2, a pressure corresponding to a sudden change of slope in the curve (i.e., the inflection point) is obtained when the gas injection medium is $CO_2$. In this case, a corresponding minimum miscible pressure (MMP) is 40.2 MPa, which indicates that the gas injection medium $CO_2$ has the miscible ability in the crude oil of the present reservoir. According to the curve characterizing a relationship between miscible pressure and recovery efficiency as shown in FIG. 3, a pressure corresponding to a sudden change of slope in the curve (i.e., the inflection point) is obtained when the gas injection medium is $CH_4$. In this case, a corresponding minimum miscible pressure (MMP) is 46 MPa, which indicates that the gas injection medium $CH_4$ has the miscible ability in the crude oil of the present reservoir. According to the curve characterizing a relationship between miscible pressure and recovery efficiency as shown in FIG. 4, there is no sudden change of slope in the curve (i.e., the inflection point) when the gas injection medium is $N_2$. As a result, there is no corresponding minimum miscible pressure (MMP) when the gas injection medium is $N_2$, which indicates that the gas injection medium $N_2$ has no miscible ability in the crude oil of the present reservoir.

Next, after the first gas injection mediums are determined based on whether each gas injection medium has a minimum miscible pressure in the crude oil of the present reservoir, a number of second gas injection mediums compatible with an average formation pressure of the present reservoir is selected from the first gas injection mediums based on the minimum miscible pressure of each first gas injection medium in combination with the average formation pressure of the present reservoir. Since the minimum miscible pressure is an important parameter for selecting injection method for reservoir, the average formation pressure of the reservoir must be higher than a minimum miscible pressure between the injected gas and the formation crude oil, in order to maximize the recovery efficiency. Accordingly, the first gas injection mediums with a minimum miscible pressure lower than the average formation pressure of the present reservoir selected from the number of first gas injection mediums is determined as the second gas injection mediums compatible with the average formation pressure of the present reservoir.

Next, each minimum miscible pressure is compared with the average formation pressure of the present reservoir, respectively, and the first gas injection mediums with a minimum miscible pressure less than the average formation pressure is obtained as the second gas injection mediums. In the embodiments of the present application, the minimum miscible pressure of each first gas injection medium is compared with the average formation pressure of the present reservoir, and the first gas injection mediums with a minimum miscible pressure less than the average formation pressure of the present reservoir are selected from the number of first gas injection mediums. Then, the first gas injection mediums selected are determined as the second gas injection mediums compatible with the average formation pressure of the present reservoir.

Finally, target gas injection mediums are determined according to a dissolution mechanism and density of each second gas injection medium in the present reservoir. In the embodiments of the present invention, the dissolution mechanism of each second gas injection medium in the present reservoir is first obtained, so as to select a first-type second gas injection medium with the best viscosity reduction effect and ability to dissolve crude oil from the number of second gas injection mediums for the present reservoir. In addition, the density of each second gas injection mediums is also obtained in the embodiments of the present invention, so as to select a second-type second gas injection medium with the minimum density from the number of second gas injection mediums. Then, the first-type second gas injection medium and the second-type second gas injection medium are determined as two target gas injection mediums in the embodiments of the present application.

Figure 5:
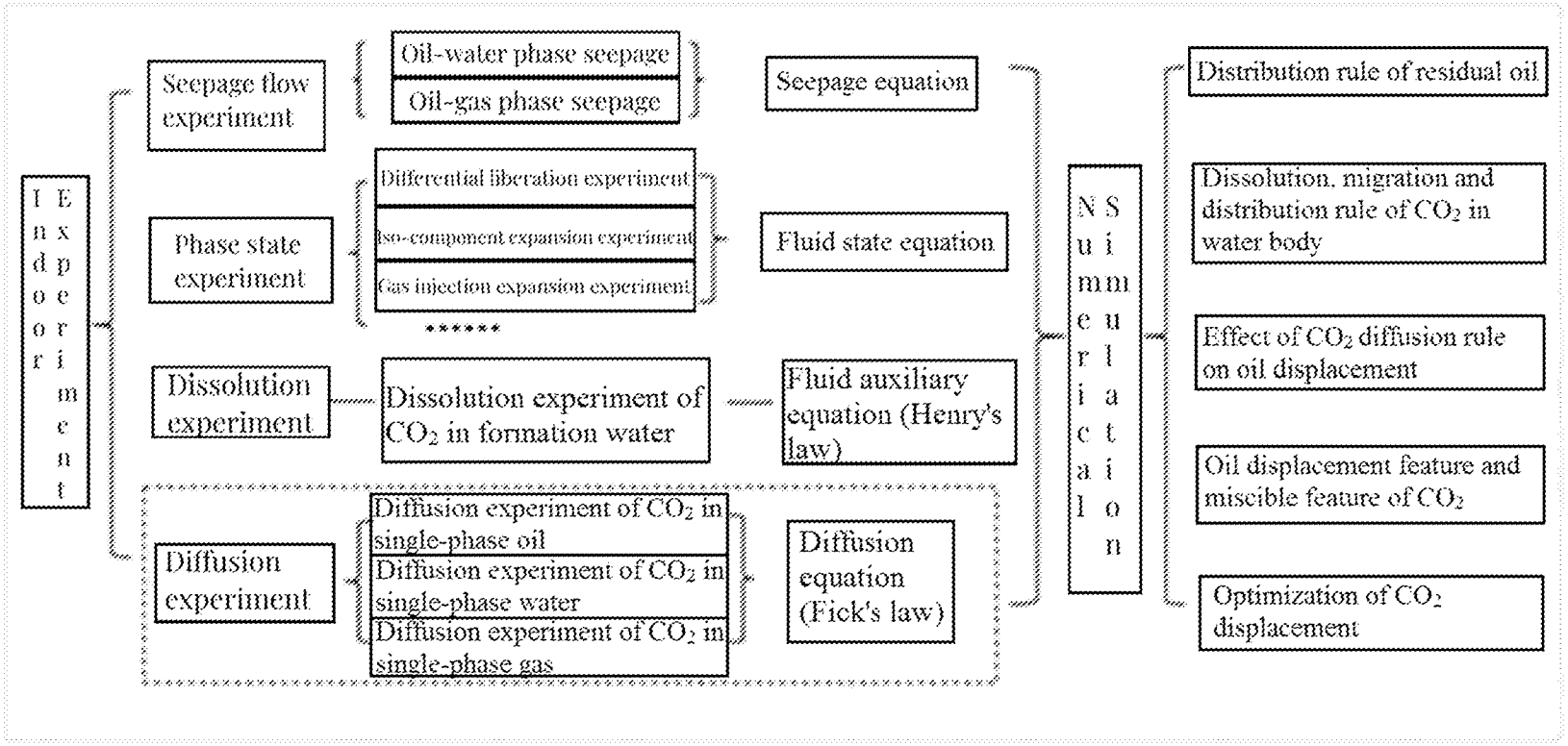
FIG. 5 is a flow chart of a numerical simulation method when gas injection medium is $CO_2$ in the gas injection method for deep-layer strong bottom water sandstone reservoir according to embodiments of the present application.
Figure 6:
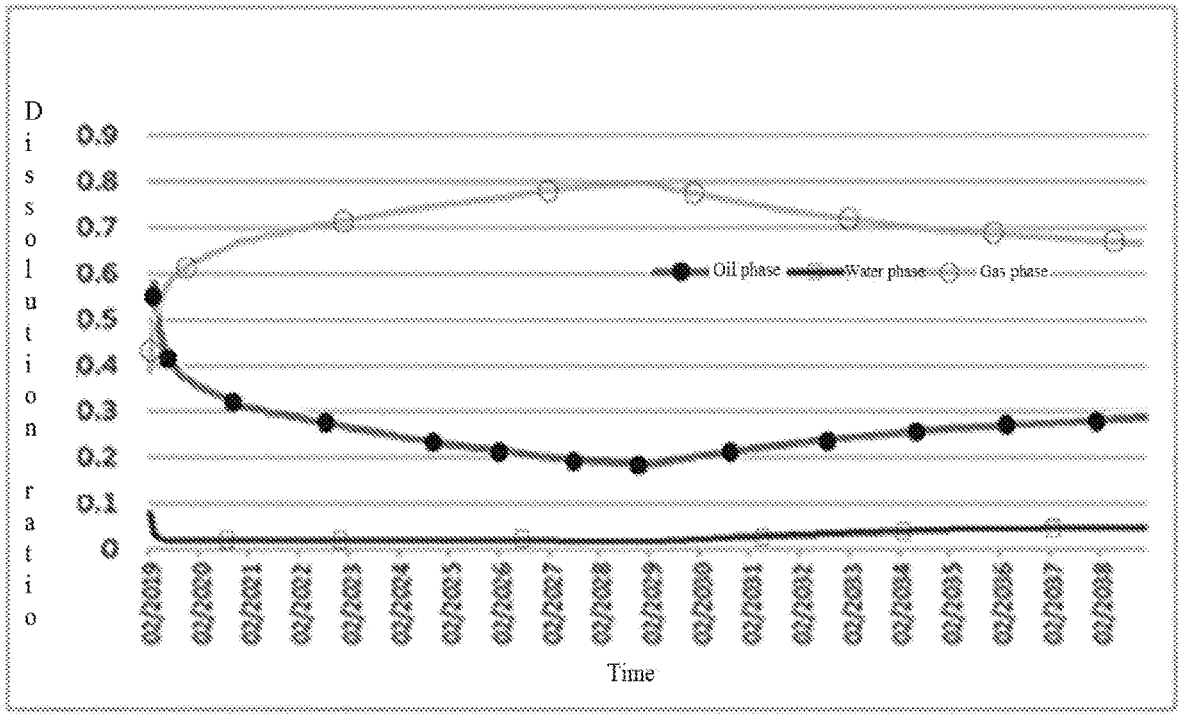
FIG. 6 shows changes of occurrence state and dissolution ratio over time when gas injection medium is $CO_2$ in the gas injection method for deep-layer strong bottom water sandstone reservoir according to embodiments of the present application.
Figure 7:
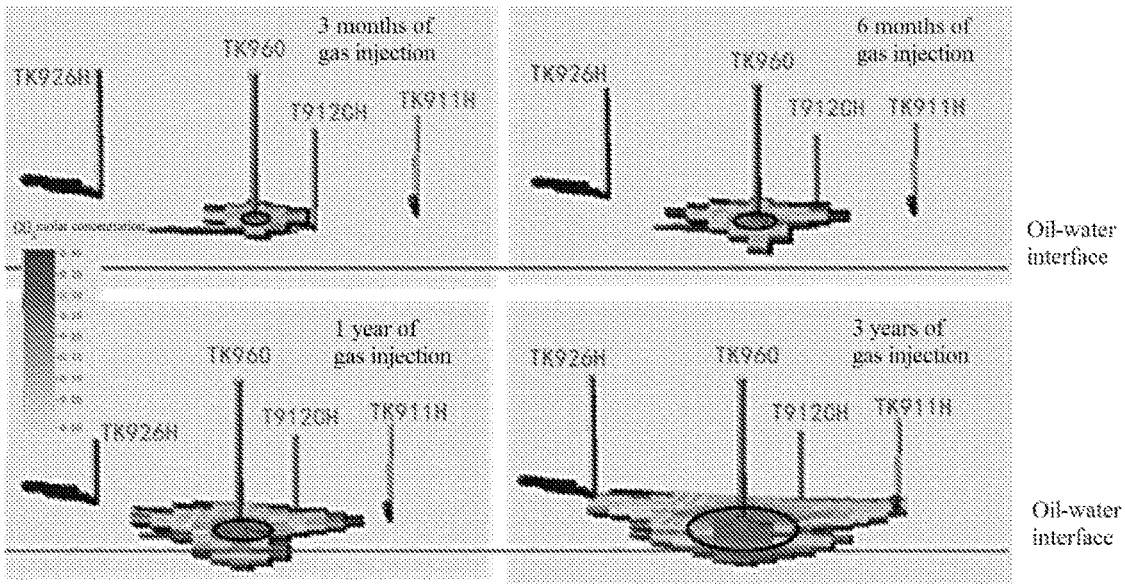
FIG. 7 schematically shows rules of concentration change during dissolution and diffusion when gas injection medium is $CO_2$ in the gas injection method for deep-layer strong bottom water sandstone reservoir according to embodiments of the present application.

Further, indoor experiments and numerical simulation are adopted to obtain distribution features and miscible features of each second gas injection medium in the reservoir, so as to obtain a first target gas injection medium (or "first-type second gas injection medium") that is soluble in water and oil. FIG. 5 is a flow chart of a numerical simulation method when gas injection medium is $CO_2$ in the gas injection method for deep-layer strong bottom water sandstone reservoir according to the embodiments of the present application. FIG. 6 shows changes of occurrence state and dissolution ratio over time when gas injection medium is $CO_2$ in the gas injection method for deep-layer strong bottom water sandstone reservoir according to the embodiments of the present application. FIG. 7 schematically shows rules of concentration change during dissolution and diffusion when gas injection medium is $CO_2$ in the gas injection method for deep-layer strong bottom water sandstone reservoir according to the embodiments of the present application. Next, a procedure of acquiring the first target gas injection medium according to the embodiments of the present application is illustrated with reference to FIGS. 5, 6 and 7.

Specifically, reservoir numerical simulation is a method to show real reservoir dynamics through establishing mathematical models that characterize a fluid permeability law in the reservoir, and simulate actual oilfield exploitation in combination with fluid mechanics based on actual situation of reservoir geology and development. As shown in FIG. 5, in the embodiments of the present application, seepage flow experiment and phase state experiment in the indoor experiments are adopted to simulate the exploitation of the present reservoir, so as to obtain changes in phase state of fluid in the present reservoir according to experimental results. Then, corresponding reservoir exploitation parameters are configured, and relevant parameters characterizing changes in phase state of fluid in the present reservoir are calculated through the numerical simulation method, so as to obtain a distribution rule of the residual oil. Next, a dissolution feature of each second gas injection medium in the formation water of the present reservoir is obtained through dissolution experiment in the indoor experiments, and thus dissolution, migration and distribution rules of each second gas injection medium in the formation water of the present reservoir are obtained through the numerical simulation method. Then, a diffusion feature of each second gas injection medium in single-phase oil, single-phase water and single-phase gas of the present reservoir is obtained through diffusion experiment in the indoor experiments, and thus the diffusion rule of each second gas injection medium in the present reservoir is obtained. On this basis, corresponding injection-production parameters are configured, and different displacement effect obtained by injecting each second gas injection medium into the present reservoir is analyzed through the numerical simulation method, in order to obtain an influence of each second gas injection medium on the displacement effect with the dissolution and diffusion rules being taken into consideration. In this manner, an accurate distribution feature (as shown in FIG. 7) and an accurate miscible feature of each second gas injection medium in the present reservoir are obtained. In the embodiments of the present application, changes of occurrence state and dissolution ratio over time for each second gas injection medium in the present reservoir (as shown in FIG. 6) characterize the corresponding miscible feature.

Next, the distribution feature and the miscible feature of each second gas injection medium in the present reservoir are combined together to obtain a concentration distribution of each second gas injection medium in the present reservoir during early, middle and subsequent depletion exploitation stages of gas injection. The second gas injection medium that has a dissolution ratio varies stably with injection time is taken as the first target gas injection medium that is soluble in oil and water.

According to relevant injection-production parameters of actual crude oil exploitation in the reservoir, it can be seen that during continuous gas injection in crude oil exploitation of the reservoir when gas injection medium is $CO_2$, the viscosity of crude oil in the reservoir significantly reduces with the increase of $CO_2$ solubility in the crude oil. In addition, the molar concentration of $CO_2$ in the reservoir will gradually increase during the exploitation, while the tension at the oil-water interface will gradually decrease with the increase of the molar concentration of $CO_2$, and thus displacement resistance of continuous gas injection will also gradually decrease. Therefore, when $CO_2$ is selected as the continuous gas injection medium, the recovery efficiency of reservoir can be significantly increased. In the embodiments of the present application, the distribution (sweep) and miscible features of the gas injection medium $CO_2$ in the present reservoir are analyzed during the early to middle stages (3 months, 6 months and 1 year of gas injection) as well as the subsequent depletion exploitation stage (3 years of gas injection) of continuous $CO_2$ injection into the same well group (well group No. TK960) of the present reservoir. On this basis, it can be seen that the molar concentration of $CO_2$ in the present reservoir gradually increases during the gas injection (as shown in darker areas of circles in FIG. 7). As a result, the tension at the oil-water interface in the present reservoir will gradually decrease. Specifically, as to the soluble distribution of $CO_2$ in the reservoir, the solubility ratio of $CO_2$ in oil and water firstly increases and then decreases during the early stage of gas injection, and then is kept as about 18 stably after one year of gas injection. Therefore, the embodiments of the present invention adopt $CO_2$ as the first target gas injection medium to substantially enhance the recovery efficiency of the present reservoir.

Further, when generating the second target gas injection medium, density data of each second gas injection medium is obtained, and a plurality of density data is sequenced, wherein the second gas injection medium with the smallest density among the plurality of second gas injection mediums is taken as the second target gas injection medium (or "second-type second gas injection medium"). According to analysis results of miscible features, the gas injection medium $CH_4$ is not only miscible with crude oil in the reservoir formation, but also has the smallest density among the plurality of second gas injection mediums ($CO_2$ and $CH_4$) in the embodiments of the present application, which helps to exploit the residual oil at the top of the reservoir. Therefore, the embodiments of the present invention adopt $CH_4$ as the second target gas injection medium to substantially enhance the recovery efficiency of the reservoir.

Next, the first target gas injection medium and the second target gas injection medium are injected individually or in combination into the present reservoir, and the exploitation rule for utilizing the residual oil in the plane in the longitudinal direction after a predetermined time is obtained for different gas injection modes, respectively. Based on which, a rule of solubility of each gas injection medium over time is obtained corresponding to each gas injection mode respectively, so as to determine the combination of gas injection mediums for which the solubility thereof is steadily increased over time as the optimal gas injection mediums.

Figure 8:
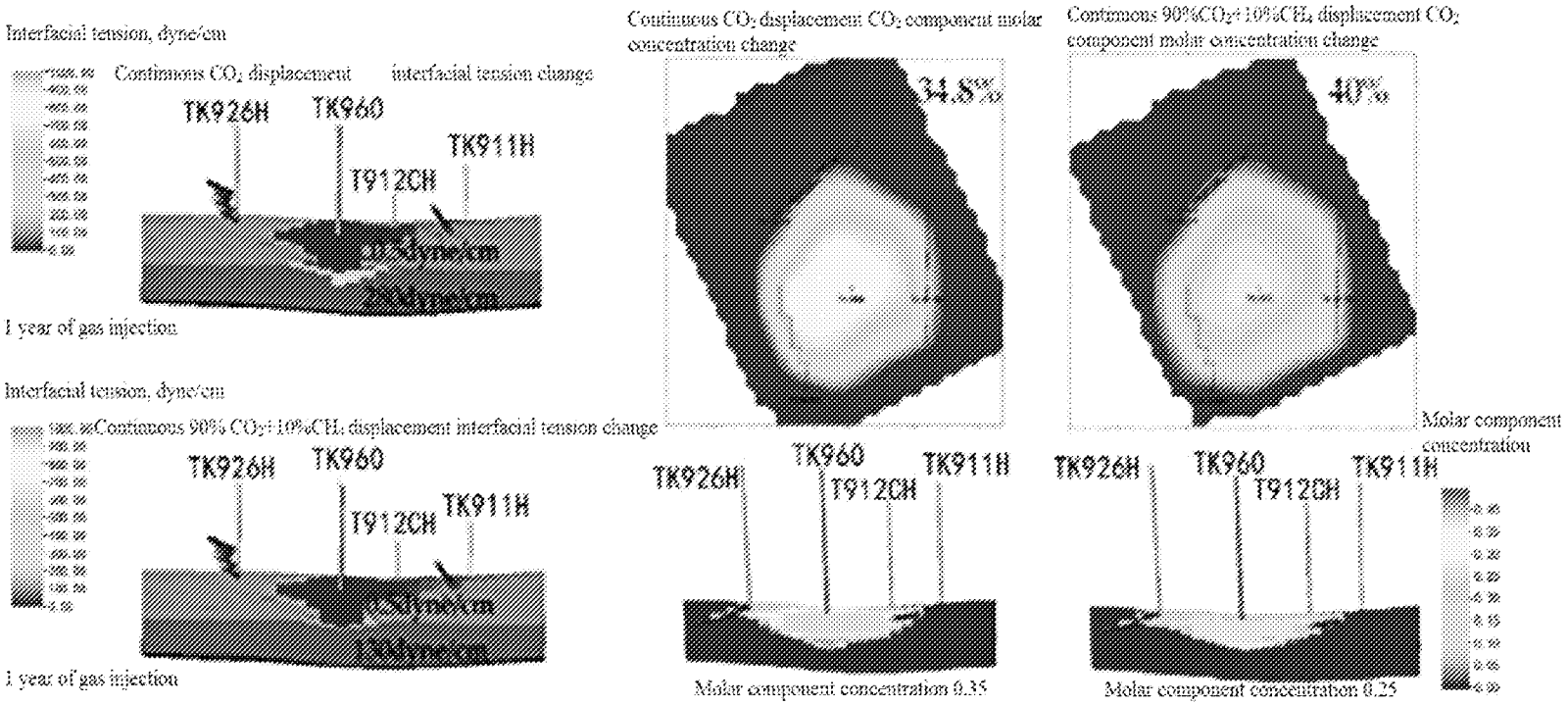
FIG. 8 schematically shows exploitation of residual oil in the gas injection method for deep-layer strong bottom water sandstone reservoir according to embodiments of the present application.

Specifically, in the embodiments of the present application a corresponding well group simulation model is constructed for a well zone which belongs to a lower part of the present reservoir and has a non-developed interlayer. FIG. 8 schematically shows exploitation of residual oil in the gas injection method for deep-layer strong bottom water reservoir according to the embodiments of the present application. Next, in the embodiments of the present application, the exploitation rule of residual oil along horizontal and longitudinal directions is analyzed one year after injecting the first target gas injection medium $CO_2$ alone into the present reservoir, and injecting a combination of the first target gas injection medium $CO_2$ and the second target gas injection medium $CH_4$ into the same well group (well group No. TK960) in the present reservoir (as shown in examples showing changes in interfacial tension on a left side of FIG. 8). Then, the exploitation rule of residual oil along horizontal and longitudinal directions is analyzed after injecting the first target gas injection medium $CO_2$ alone into the present reservoir, and injecting a combination of the first target gas injection medium $CO_2$ and the second target gas injection medium $CH_4$ into the present reservoir. In addition, it can be seen that when a combination of the first target gas injection medium $CO_2$ and the second target gas injection medium $CH_4$ is injected into the reservoir, changes in molar concentration of $CO_2$ component in the reservoir are more stable and slower compared to injecting the first target gas injection medium $CO_2$ alone, as shown in examples of distribution of changes in $CO_2$ molar component concentration in case of different gas injection methods on a right side of FIG. 8. Therefore, the first target gas injection medium $CO_2$ and the second target gas injection medium $CH_4$ are taken as the optimal gas injection mediums in the embodiments of the present application, based on which an optimal gas injection ratio of the corresponding mixed gas injection is studied.

According to step S120 in FIG. 1, an exploitation rule of the residual oil is analyzed based on a number of target gas injection mediums and in combination with a well group simulation model corresponding to the present reservoir, so as to obtain an optimal gas injection ratio between the target gas injection mediums.

Further, after obtaining the optimal gas injection mediums including the first target gas injection medium and the second target gas injection medium, different mixed ratios are configured for the first target gas injection medium and the second target gas injection medium, and gas injection simulation is performed in the well group simulation model through the preset first gas injection mode according to each mixed ratio. In this manner, an increment in recovery efficiency corresponding to each mixed ratio is obtained, thereby determining an optimal gas injection ratio. Specifically, in the embodiments of the present application, different mixed ratios are configured for the first target gas injection medium $CO_2$ and the second target gas injection medium $CH_4$ of the present reservoir, and the first target gas injection medium $CO_2$ and the second target gas injection medium $CH_4$ are mixed according to different gas injection ratios to obtain a plurality of mixed ratios. Next, one of the gas injection modes commonly used in the recovery of reservoir (e.g., continuous gas injection, cyclical gas injection with different gas injection slug ratios and water-gas alternate injection) is selected in the embodiments of the present application, and is preset as the first gas injection mode for the present reservoir. Then, through the first gas injection mode and the well group simulation model constructed based on the well zone which belongs to a lower part of the present reservoir and has a non-developed interlayer in the embodiments of the present application, gas injection simulation is performed for the present reservoir according to a plurality of mixed ratios, so as to obtain an increment in recovery efficiency corresponding to each mixed ratio. The mixed ratio with the maximum increment in the recovery efficiency is taken as the optimal gas injection ratio of the present reservoir.

Figure 9:
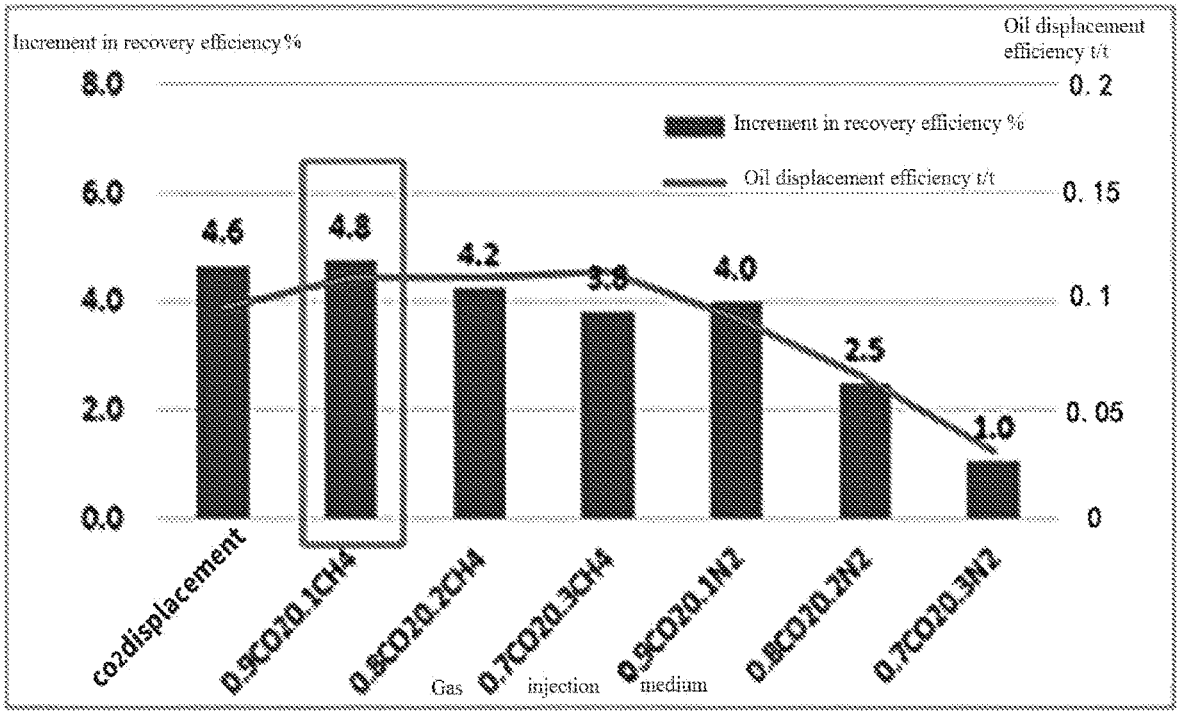
FIG. 9 schematically shows a relationship between mixed ratio and increment in recovery efficiency in the gas injection method for deep-layer strong bottom water sandstone reservoir according to embodiments of the present application.
Figure 10:
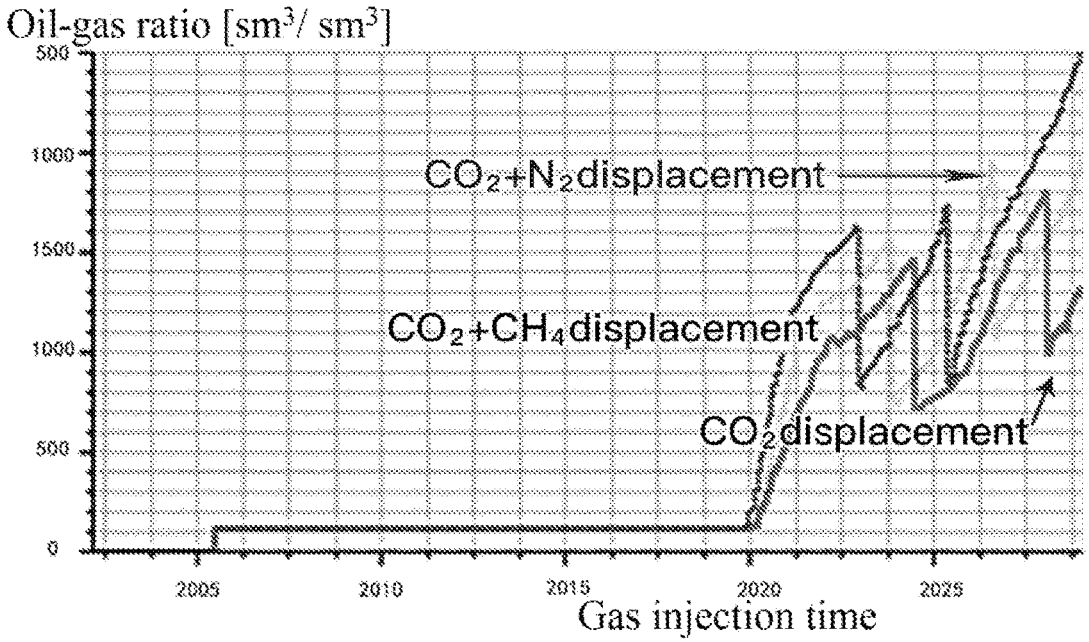
FIG. 10 schematically shows changes in gas-oil ratios corresponding to different combinations of gas injection mediums in the gas injection method for deep-layer strong bottom water sandstone reservoir according to embodiments of the present application.

FIG. 9 schematically shows a relationship between mixed ratio and increment in recovery efficiency in gas injection methods for deep-layer strong bottom water sandstone reservoir according to the embodiments of the present application. In one embodiment of the present application, the first target gas injection medium $CO_2$ and the second target gas injection medium $CH_4$ of the present reservoir are mixed according to different gas injection ratios, in order to obtain a plurality of mixed ratios (e.g., 0.9 $CO_2$0.1$CH_4$, 0.8 $CO_2$0.2$CH_4$ and 0.7 $CO_2$0.3$CH_4$). Then, based on the preset first gas injection mode and the well group simulation model constructed according to the well zone of the present reservoir, gas injection simulation is performed for the present reservoir according to the plurality of mixed ratios, in order to obtain an increment in the recovery efficiency corresponding to each mixed ratio (as shown in FIG. 9). The mixed ratio with the maximum increment in the recovery efficiency (i.e., 0.9$CO_2$0.1$CH_4$) is taken as the optimal gas injection ratio of the present reservoir. Furthermore, FIG. 10 schematically shows changes in gas-oil ratio corresponding to different combinations of gas injection mediums in the gas injection methods for deep-layer strong bottom water reservoir according to the embodiments of the present application. As shown in FIG. 10, in one embodiment of the present application, based on different target gas injection mediums or combinations thereof (e.g., a combination of $CO_2$ and $CH_4$, a combination of $CO_2$ and $N_2$, and $CO_2$ alone), gas injection simulation is performed for the present reservoir through the well group simulation model, in order to obtain a relationship between gas injection duration of each target gas injection medium or combination thereof in the present reservoir and gas-oil ratio of the present reservoir. After the crude oil of the reservoir enters the subsequent depletion exploitation stage (the year 2020), both the injection of one single target gas injection medium and a combination of target gas injection mediums will result in a significant increase in gas-oil ratio of crude oil (as shown in FIG. 10), and thus result in a decrease in recovery efficiency. Hence, an optimal gas injection mode for the present reservoir is also studied in the embodiments of the present application.

Further, in step S130, gas injection simulation is performed for the present reservoir through the plurality of gas injection modes, respectively, based on the optimal gas injection ratio and in combination with the well group simulation model, and an increment in recovery efficiency corresponding to each gas injection mode is obtained. On this basis, an optimal gas injection mode is determined. First, a plurality of gas injection modes is configured for the present reservoir. Then, based on the optimal gas injection ratio obtained in step S120, gas injection simulation is performed for the present reservoir through each gas injection mode and the well group simulation model constructed based on the well zone of the present reservoir, so as to obtain an increment in recovery efficiency corresponding to each gas injection mode, based on which an optimal gas injection mode is determined.

Further, in the embodiments of the present invention, a plurality of gas injection modes for determining the optimal gas injection mode for the present reservoir include a continuous gas injection mode, a gas injection mode with different gas injection slug ratios, a cyclical gas injection mode, and a water-gas alternate gas injection mode. In accordance with the optimal gas injection ratio determined in step S120, gas injection simulation is performed for the present reservoir through the continuous gas injection mode, the gas injection mode with different gas injection slug ratios, the cyclical gas injection mode, and the water-gas alternate gas injection mode, respectively, and through the well group simulation model constructed based on the well zone of the present reservoir, so as to obtain an increment in recovery efficiency corresponding to each gas injection mode. On this basis, the gas injection mode with the maximum increment in recovery efficiency is determined as the optimal gas injection mode for the present reservoir.

Figure 11:
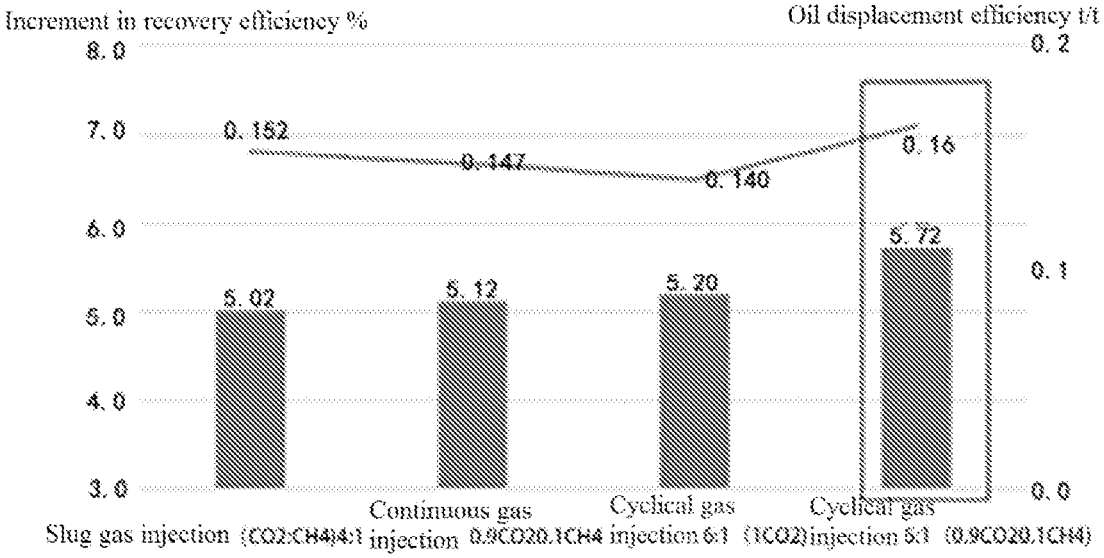
FIG. 11 schematically shows a relationship between gas injection mode and increment in recovery efficiency in the gas injection method for deep-layer strong bottom water sandstone reservoir according to embodiments of the present application.

FIG. 11 schematically shows a relationship between gas injection mode and increment in recovery efficiency in gas injection method for deep-layer strong bottom water sandstone reservoir according to the embodiments of the present application. In the embodiments of the present application, based on the optimal gas injection ratio obtained in step S120, gas injection simulation is performed in the present reservoir based on the well group simulation model through the gas injection mode with different gas injection slug ratios, the continuous gas injection mode, and the cyclical gas injection mode. The gas injection mode with the maximum increment in recovery efficiency obtained in this manner is the cyclical gas injection mode (as shown FIG. 11). Therefore, the cyclical gas injection mode is determined as the optimal gas injection mode in the embodiments of the present application.

Further, in step S140, gas injection is performed in the present reservoir based on the optimal gas injection mode and the optimal gas injection ratio. According to the target gas injection medium for the present reservoir determined in step S110, the optimal gas injection ratio determined in step S120 and the optimal gas injection mode determined in step S130, gas injection is performed in the present reservoir, thus significantly enhancing the recovery efficiency of the present reservoir.

Furthermore, different groups of injection-production parameters are configured for the present reservoir according to the present invention. According to the target gas injection medium for the present reservoir determined in step S110, the optimal gas injection ratio determined in step S120 and the optimal gas injection mode determined in step S130, gas injection simulation is performed in the present reservoir based on different groups of injection-production parameters and the well group simulation model constructed according to the well zone of the present reservoir, in order to obtain an increment in recovery efficiency corresponding to each injection-production parameter group. The injection-production parameter group with the maximum increment in recovery efficiency is determined as the optimal injection-production parameter of the present reservoir.

Figure 12:
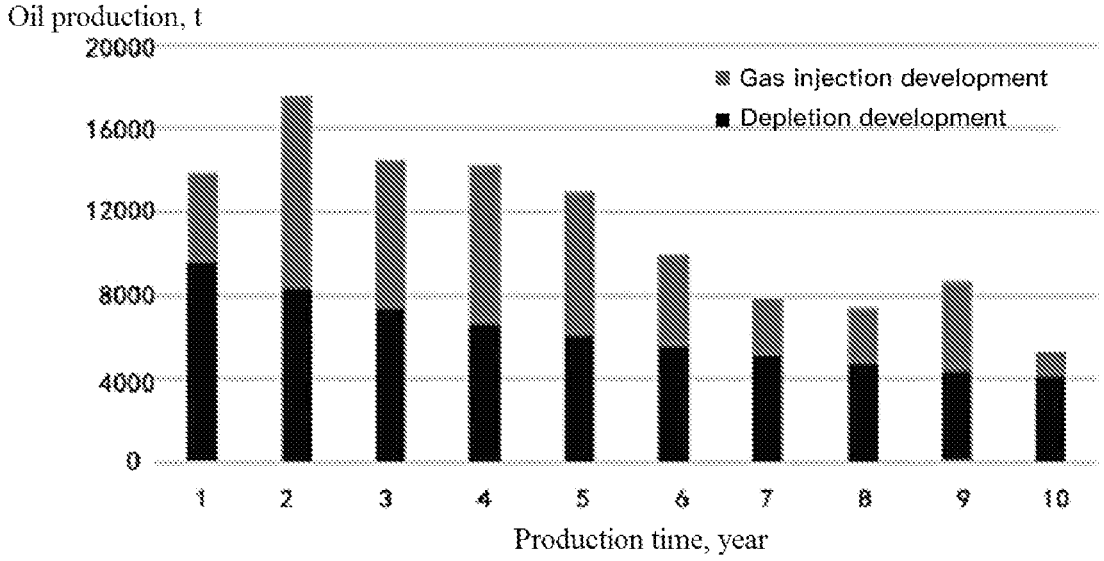
FIG. 12 schematically shows predicted annual oil production of the gas injection method for deep-layer strong bottom water sandstone reservoir according to embodiments of the present application.

FIG. 12 schematically shows predicted annual oil production of the gas injection method for deep-layer strong bottom water sandstone reservoir according to the embodiments of the present application. After the present reservoir enters the subsequent depletion exploitation stage, according to the target gas injection medium for the present reservoir determined in step S110, the optimal gas injection ratio determined in step S120 and the optimal gas injection mode determined in step S130, and in combination with the optimal injection-production parameter, gas injection simulation is performed in the present reservoir based on the well group simulation model constructed according to the well zone of the present reservoir, in order to predict annual oil production of the well group of the present reservoir. The optimized results are obtained as shown in FIG. 12. After 10 years of gas injection, the oil production of the well group in the present reservoir can be increased by 50,400 tons in total, the degree of recovery reaches 52.84%, and the corresponding recovery efficiency can be increased by 6.1%. In the embodiments of the present invention, the recovery efficiency of the gas injection can be enhanced for the well group with high water content in the present reservoir.

Second Embodiment

Figure 13:
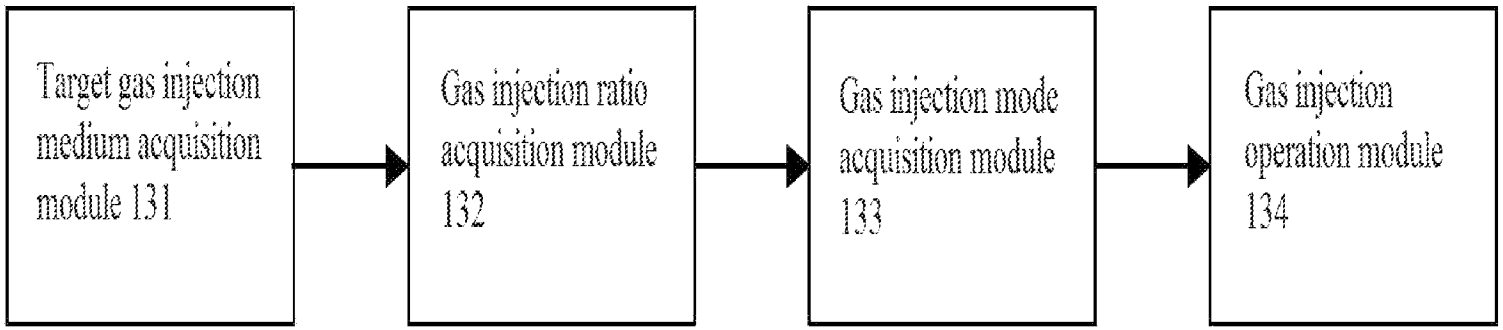
FIG. 13 is a block diagram showing a gas injection system for deep-layer strong bottom water sandstone reservoir according to embodiments of the present application.

Based on the gas injection method for deep-layer strong bottom water sandstone reservoir as illustrated in the above first embodiment, the second embodiment of the present invention provides a gas injection system for deep-layer strong bottom water reservoir (hereinafter referred to as "the gas injection system"). FIG. 13 is a block diagram showing the gas injection system for deep-layer strong bottom water sandstone reservoir according to the embodiments of the present application.

As shown in FIG. 13, the gas injection system in the embodiments of the present invention comprises a target gas injection medium acquisition module 131, a gas injection ratio acquisition module 132, a gas injection mode acquisition module 133 and a gas injection operation module 134. Specifically, the target gas injection medium acquisition module 131 is configured according to step S110 as illustrated above, so that a plurality of gas injection mediums is configured for the deep-layer strong bottom water reservoir at issue, and the miscible feature of each gas injection medium in the crude oil of the present reservoir is analyzed to select a number of target gas injection mediums that are conducive to utilizing the residual oil in the present reservoir from the plurality of gas injection mediums. The gas injection ratio acquisition module 132 is configured according to step S120 as illustrated above, so that the exploitation rule of the residual oil is analyzed based on the number of target gas injection mediums obtained by the target gas injection medium acquisition module 131, and in combination with the well group simulation model corresponding to the present reservoir, in order to obtain an optimal gas injection ratio between each target gas injection medium. The gas injection method acquisition module 133 is configured according to step S130 as illustrated above, so that gas injection simulation is performed in the present reservoir through a plurality of gas injection modes according to the optimal gas injection ratio obtained by the gas injection ratio acquisition module 132 and in combination with the well group simulation model, whereby an increment in the recovery efficiency corresponding to each gas injection method is obtained, based on which the optimal gas injection mode is determined. The gas injection operation module 134 is configured according to step S140 as illustrated above, so that gas injection is performed in the present reservoir based on the optimal gas injection mode obtained by the gas injection method acquisition module 133 and the optimal gas injection ratio obtained in the gas injection ratio acquisition module 132.

The present invention proposes a gas injection method and system for deep-layer strong bottom water sandstone reservoir. This method and system obtains a number of target gas injection mediums that are conducive to utilizing the residual oil in the present reservoir by evaluating the miscible ability of a plurality of gas injection mediums and the crude oil in the present reservoir. Then, according to a well group simulation model constructed based on the deep-layer strong bottom water reservoir at issue, gas injection simulation is performed for a number of target gas injection mediums with different mixed ratios and one single target gas injection medium, respectively, in order to analyze an exploitation rule of the residual oil and determine that miscible gas displacement is more conducive to utilizing residual oil at the top of the present reservoir. On this basis, an increment in recovery efficiency corresponding to each mixed ratio is calculated to obtain an optimal gas injection ratio. Next, gas injection simulation is performed in a well group simulation model through different gas injection modes and a number of target gas injection mediums with the optimal gas injection ratio. On this basis, an increment in recovery efficiency corresponding to each gas injection mode is calculated to obtain an optimal gas injection mode. Finally, gas injection is performed in the present reservoir through the optimal gas injection mode and the number of target gas injection mediums according to the optimal gas injection ratio. The present invention optimizes the combination of gas injection mediums and gas injection mode for improving the recovery efficiency, thereby significantly enhancing the recovery efficiency of well group with thin effective thickness of reservoir (<10 m), significant oil-water interface uplift (average uplift of 5.03 m), low residual oil saturation (35%~50%), high comprehensive water content, high degree of recovery, and non-developed interlayer. In the present invention, the recovery efficiency can be improved by 6.1% compared to depletion exploitation. Therefore, the present invention realizes effective oil stabilization and water control in the high water content development stage of deep-layer strong bottom water reservoirs, significantly improves the recovery efficiency in the middle and late stages of reservoir exploitation, and at the same time, proposes a new development approach for bypass flow field and expansion of swept area in high water-content stage in the middle and late stages of development of typical reservoirs at home and abroad.

The foregoing is merely illustrative of preferred embodiments of the present invention, but the scope of protection of the present invention is not limited thereto. Any modifications or substitutions that can be readily conceived by one skilled in the art within the technical scope disclosed herein shall fall within the scope of protection of the present invention. Therefore, the scope of protection of the present invention should be determined according to the scope of protection of the claims.

Of course, the present invention may have various other embodiments. Without departing from the spirit of the present invention and the essence thereof, one skilled in the art can make various modifications and deformations according to the present invention, which, however, shall fall within the scope of protection of the claims of the present invention.

It should be understood by one skilled in the art that the above modules or steps of the present invention can be realized by common computing devices installed on a single computing device, or distributed on a network comprising a plurality of computing devices. Optionally, the above modules or steps can be realized by program codes executable by computing devices, whereby they can be stored in a storage device and executed by computing devices, or they can be made separately into integrated circuit modules or a single integrated circuit module. In this manner, the present invention is not limited to any particular combination of hardware and software.

Although the embodiments of the present invention are described hereinabove, the disclosure is provided for facilitating to understand the implementing mode of the present invention, but rather restricting the present invention. Without departing from the spirit and scope of the present disclosure, one skilled in the art can make various modifications and improvements in forms and details of the implementing mode. The scope of protection of the present invention shall be determined by the appending claims.

The invention claimed is:

1. A gas injection method for deep-layer strong bottom water sandstone reservoir, comprising:

S1: providing a plurality of gas injection mediums for a present reservoir at issue, and analyzing a miscible feature of each gas injection medium in crude oil of the present reservoir to select a number of target gas injection mediums that are conducive to utilizing residual oil in the present reservoir from the plurality of gas injection mediums;

S2: combining the number of target gas injection mediums with a well group simulation model corresponding to the present reservoir to analyze an exploitation rule of the residual oil, thus obtaining an optimal gas injection ratio between the target gas injection mediums;

S3: performing, based on the optimal gas injection ratio and the well group simulation model, gas injection simulation for the present reservoir through a plurality of gas injection modes to obtain an increment in recovery efficiency corresponding to each gas injection mode, thereby determining an optimal gas injection mode; and S4: performing gas injection in the present reservoir through the optimal gas injection mode according to the optimal gas injection ratio, wherein, in S1, the step of analyzing the miscible feature of each gas injection medium in crude oil of the present reservoir comprises:

S11: determining whether each gas injection medium has a minimum miscible pressure in the crude oil of the present reservoir to select a plurality of first gas injection mediums that are miscible;

S12: selecting a plurality of second gas injection mediums compatible with an average formation pressure of the present reservoir from the plurality of first gas injection mediums according to a minimum miscible pressure of each first gas injection medium in combination with the average formation pressure of the present reservoir; and S13: determining the target gas injection mediums according to dissolution rule and density of each second gas injection medium in the present reservoir, which comprises:

S131: obtaining, through a combination of indoor experiments and numerical simulation, a distribution feature and a miscible feature of each second gas injection medium in the present reservoir, a first target gas injection medium that is soluble in water and oil; and S132: determining a second gas injection medium with a smallest density as a second target gas injection medium, wherein S131 comprises:

performing exploitation simulation for the present reservoir through seepage flow experiment and phase state experiment, thus obtaining changes in phase state of fluid in the present reservoir;

configuring reservoir exploitation parameters, and calculating relevant parameters characterizing the changes in phase state of fluid in the present reservoir through numerical simulation to obtain a distribution rule of the residual oil;

obtaining a dissolution feature of each second gas injection medium in formation water of the present reservoir through dissolution experiment to obtain dissolution, migration and distribution rules of each second gas injection medium in formation water of the present reservoir through numerical simulation;

obtaining a diffusion feature of each second gas injection medium in single-phase oil, single-phase water and single-phase gas of the present reservoir through diffusion experiment to obtain the diffusion rule of each second gas injection medium in the present reservoir;

configuring injection-production parameters to analyze, through numerical simulation, different displacement effect obtained by injecting each second gas injection medium into the present reservoir, in order to obtain an influence of each second gas injection medium on displacement effect with the dissolution and diffusion rules being taken into consideration; and combining the distribution feature and the miscible feature of each second gas injection medium in the present reservoir together to obtain a concentration distribution of each second gas injection medium in the present reservoir during early, middle and subsequent depletion exploitation stages of gas injection, respectively, so that the gas injection medium having a dissolution ratio that varies stably with injection time is taken as the first target gas injection medium that is soluble in oil and water.

2. The method according to claim 1, wherein S11 comprises:

obtaining, based on a slim-tube miscible experiment in combination with numerical simulation and prediction, a correlation between miscible pressure and recovery efficiency of each gas injection medium in the crude oil of the present reservoir, and selecting the first gas injection mediums by determining whether each gas injection medium has a minimum miscible pressure in the crude oil of the present reservoir.

3. The method according to claim 2, comprising drawing a curve that shows the correlation between the miscible pressure and the recovery efficiency of each gas injection medium is drawn to determine whether a current gas injection medium is miscible in the present reservoir based on an inflection point of slope of the curve, wherein, when the curve has the inflection point, a pressure at the inflection point is taken as the minimum miscible pressure, and when the curve does not have the inflection point, the current gas injection medium is not miscible in the present reservoir.

4. The method according to claim 1, wherein S12 comprises:

comparing the minimum miscible pressure of each first gas injection medium with the average formation pressure to obtain the first gas injection mediums with the minimum miscible pressure less than the average formation pressure as the plurality of second gas injection mediums.

5. The method according to claim 1, wherein S2 comprises:

configuring different mixed ratios for the first target gas injection medium and the second target gas injection medium, and performing gas injection simulation in the well group simulation model through a preset first gas injection mode according to each mixed ratio to obtain an increment in recovery efficiency corresponding to each mixed ratio, thereby determining the optimal gas injection ratio.

6. The method according to claim 1, wherein the gas injection modes are selected from continuous gas injection, gas injection with different gas injection slug ratios, cyclical gas injection, and water-gas alternate injection.

7. The method according to claim 6, wherein S3 comprises:

performing gas injection simulation in the well group simulation model according to the optimal gas injection ratio to obtain an increment in recovery efficiency corresponding to each gas injection mode, thereby determining the gas injection mode with a largest increment in recovery efficiency as the optimal gas injection mode.

8. The method according to claim 1, further comprising:

configuring different injection-production parameters for the present reservoir; and performing, based on the target gas injection mediums, the optimal gas injection ratio and the optimal gas injection mode, gas injection simulation in the present reservoir through the well group simulation model according to each injection-production parameter to obtain an increment in recovery efficiency corresponding to each injection-production parameter, based on which an optimal injection-production parameter of the present reservoir is determined.

9. The method according to claim 1, wherein the gas injection mediums are selected from $CO_2$, $CH_4$, and $N_2$.

* * * * *